US005688209A

United States Patent [19]

Trulaske et al.

[11] Patent Number: 5,688,209

[45] Date of Patent: Nov. 18, 1997

[54] ARM POWERED TREADMILL

[75] Inventors: Frank R. Trulaske, St. Louis, Mo.; Daniel R. Moon, Riverside, Ill.

[73] Assignee: True Fitness Technology, Inc., O'Fallon, Mo.

[21] Appl. No.: 591,768

[22] Filed: Jan. 25, 1996

[51] Int. Cl.[6] ..... A63B 22/02

[52] U.S. Cl. ..... 482/54

[58] Field of Search ..... 482/54, 51, 64

[56] References Cited

U.S. PATENT DOCUMENTS

| | | |
|---|---|---|
| Re. 34,478 | 12/1993 | Dalebout et al. . |
| 1,211,765 | 1/1917 | Schmidt . |
| 3,216,722 | 11/1965 | Odom . |
| 4,188,030 | 2/1980 | Hooper . |
| 4,512,571 | 4/1985 | Hermelin . |
| 4,529,195 | 7/1985 | Stevens . |
| 4,712,790 | 12/1987 | Szymski . |
| 4,869,494 | 9/1989 | Lambert, Sr. . |
| 4,880,225 | 11/1989 | Lucas et al. . |
| 4,911,425 | 3/1990 | Kynast et al. . |
| 4,960,276 | 10/1990 | Feuer et al. . |
| 4,966,362 | 10/1990 | Ramaekers . |
| 4,979,731 | 12/1990 | Hermelin . |
| 4,986,533 | 1/1991 | Lo . |
| 5,058,888 | 10/1991 | Walker et al. . |
| 5,110,117 | 5/1992 | Fisher et al. . |
| 5,192,257 | 3/1993 | Panasewicz . |
| 5,209,715 | 5/1993 | Walker et al. . |

FOREIGN PATENT DOCUMENTS

| | | |
|---|---|---|
| 966865 | 4/1975 | Canada . |

*Primary Examiner*—Lynne A. Reichard
*Attorney, Agent, or Firm*—Leydig, Voit & Mayer, Ltd.

[57] ABSTRACT

A motorless treadmill for exercising the upper body and lower body of a user. Displacement of an upper-body exercise mechanism such as a pair of reciprocating arm members rotates a drive roller. The drive roller is coupled to an endless belt, and a transmission system links the drive roller to the upper body exercise mechanism such that arm movements are translated into belt rotation. In one embodiment, pulleys are used as the transmission system to transmit the energy from the movement of the arm members to the belt. A flywheel may be added to store energy to smooth the belt rotation.

18 Claims, 5 Drawing Sheets

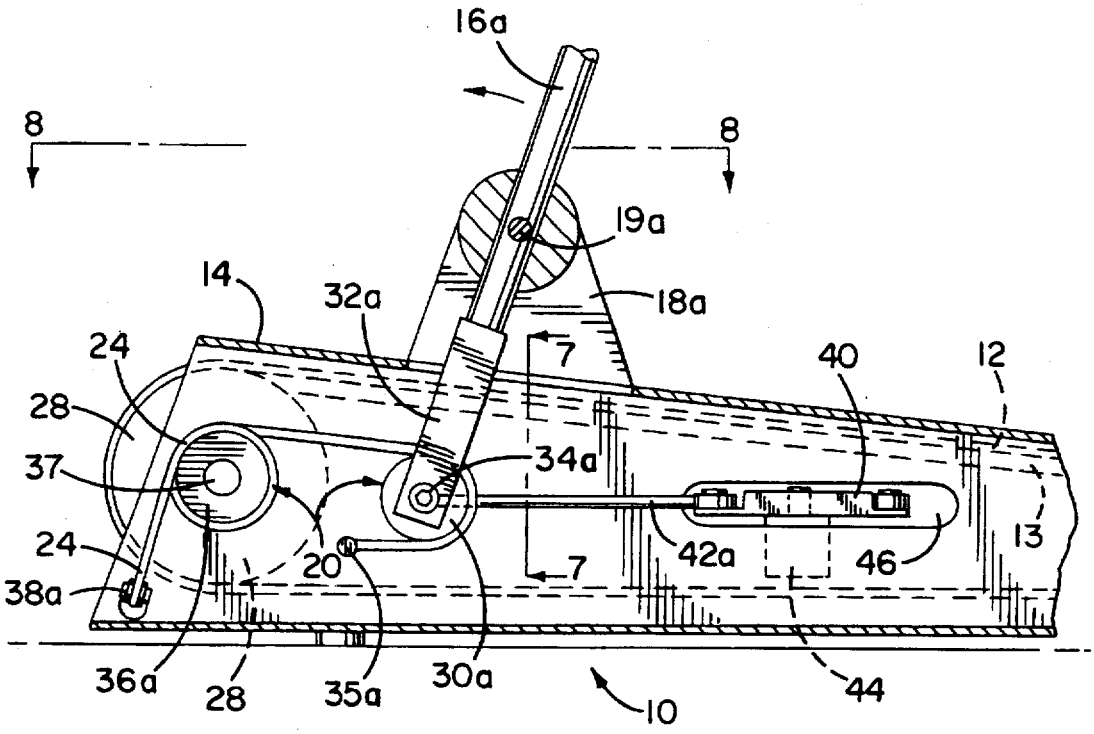
FIG. 5
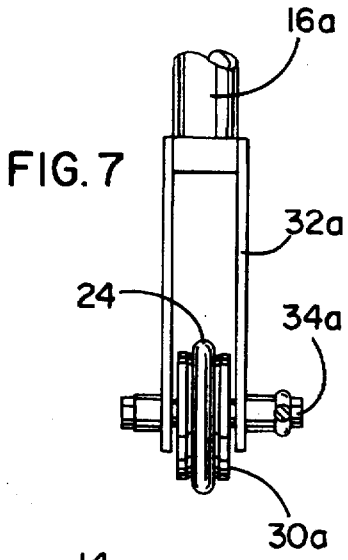
FIG. 7
FIG. 6
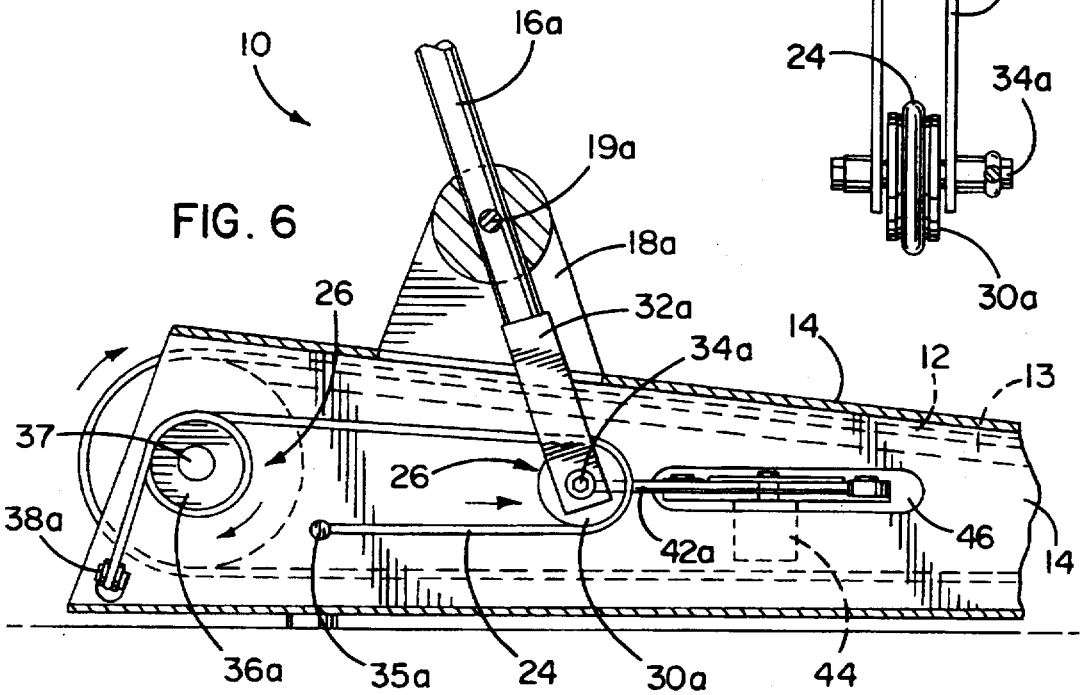

ARM POWERED TREADMILL

FIELD OF THE INVENTION

The invention relates generally to exercise equipment, and in particular to a treadmill for exercising the upper and lower body of a user.

BACKGROUND OF THE INVENTION

Conventional treadmills employ a motor to rearwardly drive an endless belt. Generally, a user of a conventional treadmill is able to vary the speed and incline of the treadmill to obtain a desired level of workout. More sophisticated treadmills, such as described in U.S. Pat. No. 5,462,504 and assigned to the assignee of the present application, automatically adjust the speed and incline of the treadmill to control the heart rate of the user.

In general, treadmills function to exercise the user's cardiovascular system and the skeletal muscles of the lower body, but do not exercise the upper body to any significant extent. Accordingly, a number of treadmills have upper body exercise devices associated therewith, such as arm members which are moveable against the resistance of a spring.

While conventional motor-driven treadmills provide a desirable exercise apparatus in appropriate settings, in other settings the motor makes such an apparatus undesirable. For example, motors need maintenance, can fail, need to be plugged into a power source and add to the weight of the treadmill, while the expense of the motor is a major factor in treadmill purchases.

As a result, simple treadmills are known which do not use motors, but are instead designed to be inclined such that the belt rotates rearwardly as a result of the weight and forward stride of the user overcoming belt friction. However, once the incline is set, these types of treadmills feel unnatural to a user because changes to the belt speed depend upon the amount of additional rearward force a user is able to apply. For example, without interrupting an exercise session to adjust the incline, a user wishing to increase the speed of a gravity-driven belt must push down and/or forwardly on hand rails or arm members in order to change the amount of rearward force applied to the belt. Such a workout is not at all like a person's natural stride when increasing or decreasing speed.

SUMMARY OF THE INVENTION

Accordingly, it is a primary object of the invention to provide a motorless treadmill that exercises the upper and lower body of a user.

In accomplishing that object, it is a related object to provide a treadmill of the above kind wherein the stride of a user feels relatively natural as the user varies the speed.

It is another object to provide a treadmill wherein the amount of upper body exercise can be varied with respect to the amount of lower body exercise.

Another object is to provide a treadmill as characterized above which is lightweight in design and relatively uncomplicated.

Briefly, the present invention provides a treadmill for exercising the upper body and lower body of a user, wherein displacement of an upper-body exercise means drives an endless belt to rotate in one direction around the support frame. The treadmill includes a substantially stationary support frame, an endless belt longitudinally encircling the support frame, and a displaceable upper-body exercise means, such as generally upright arm members. A drive roller is coupled to the belt, and a transmission means links the drive roller to the upper body exercise means such that arm movements are translated into belt rotation.

Other objects and advantages will become apparent from the following detailed description when taken in conjunction with the drawings, in which:

BRIEF DESCRIPTION OF THE DRAWINGS

FIGS. 5 and 6 comprise front, left side views of the treadmill illustrating the components of the transmission mechanism in more detail when the lower end of the left arm member is in forward and rearward positions, respectively;

FIG. 7 is a front view of the lower portion of an arm member illustrating a pulley wheel attached thereto;

Figure 1:
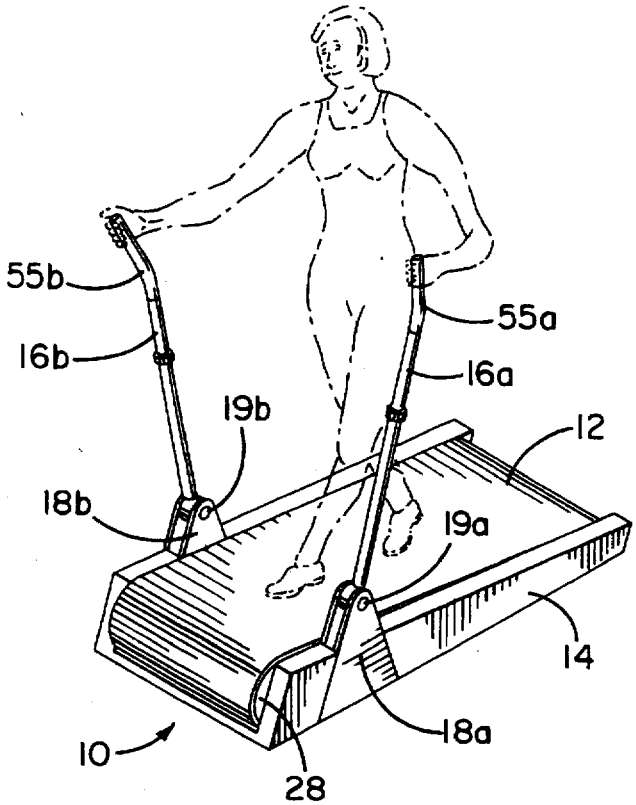
FIG. 1 is a perspective view illustrating a treadmill constructed in accordance with to the invention and having a user thereon.

While the invention is susceptible to various modifications and alternative constructions, a certain illustrated embodiment thereof is shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

Figure 2:
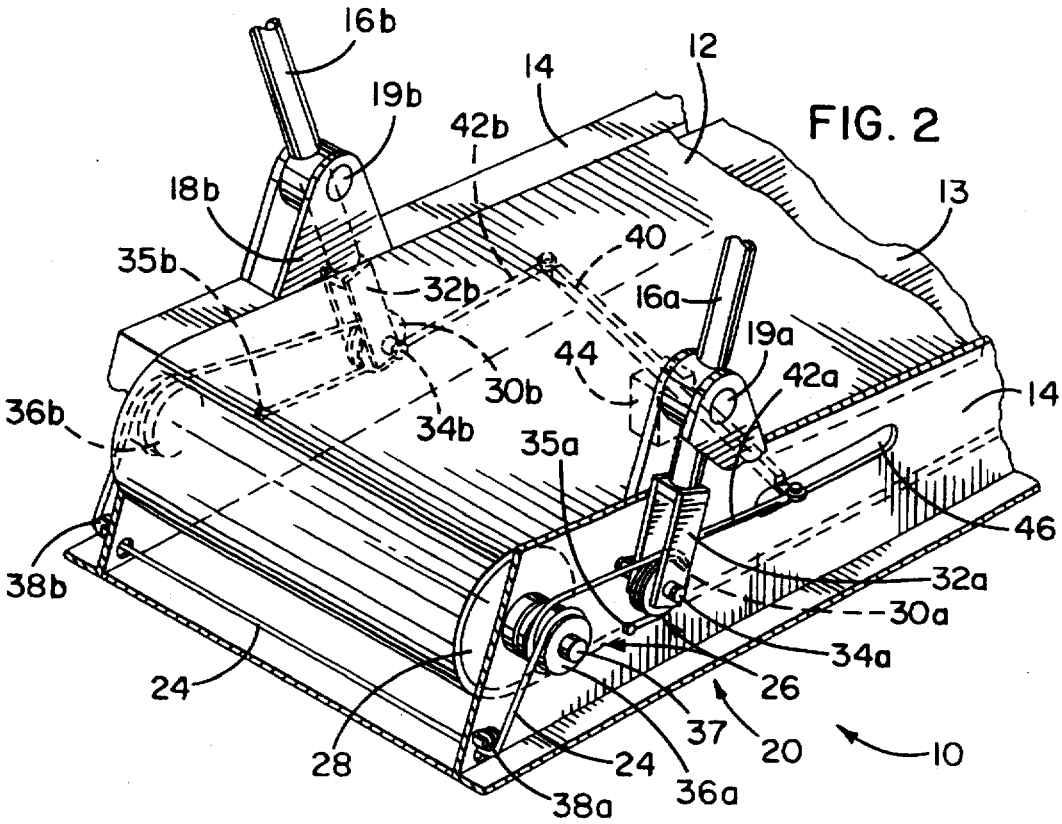
FIG. 2 is a partial perspective view of the treadmill of FIG. 1 illustrating a mechanism for transmitting arm movements into belt rotation according to one aspect of the invention.
Figure 3:
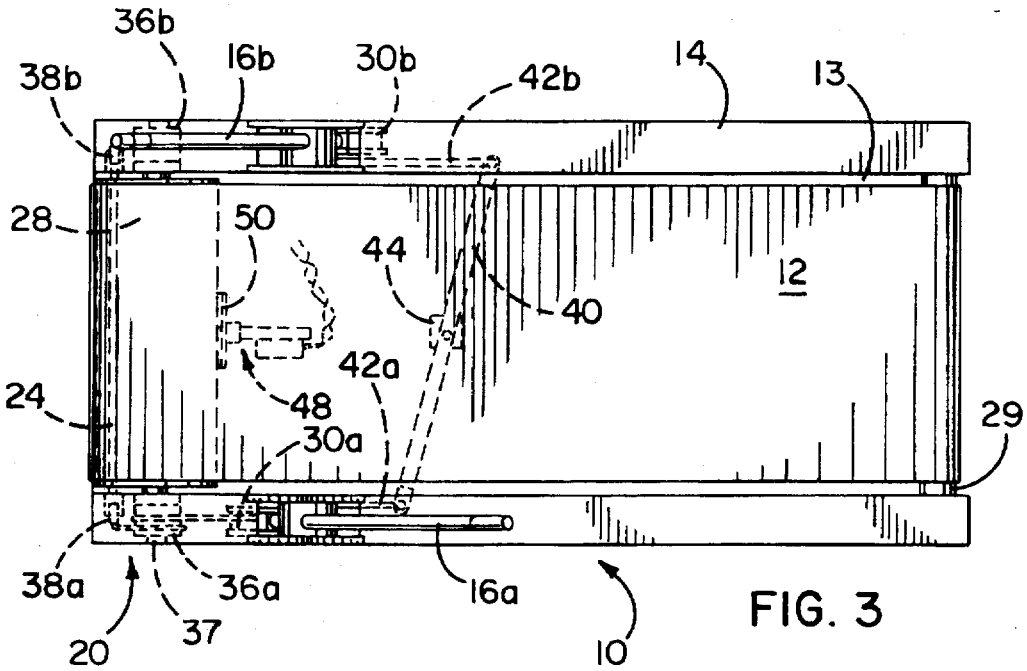
FIG. 3 is a top plan view of the treadmill of FIGS. 1 and 2.
Figure 4:
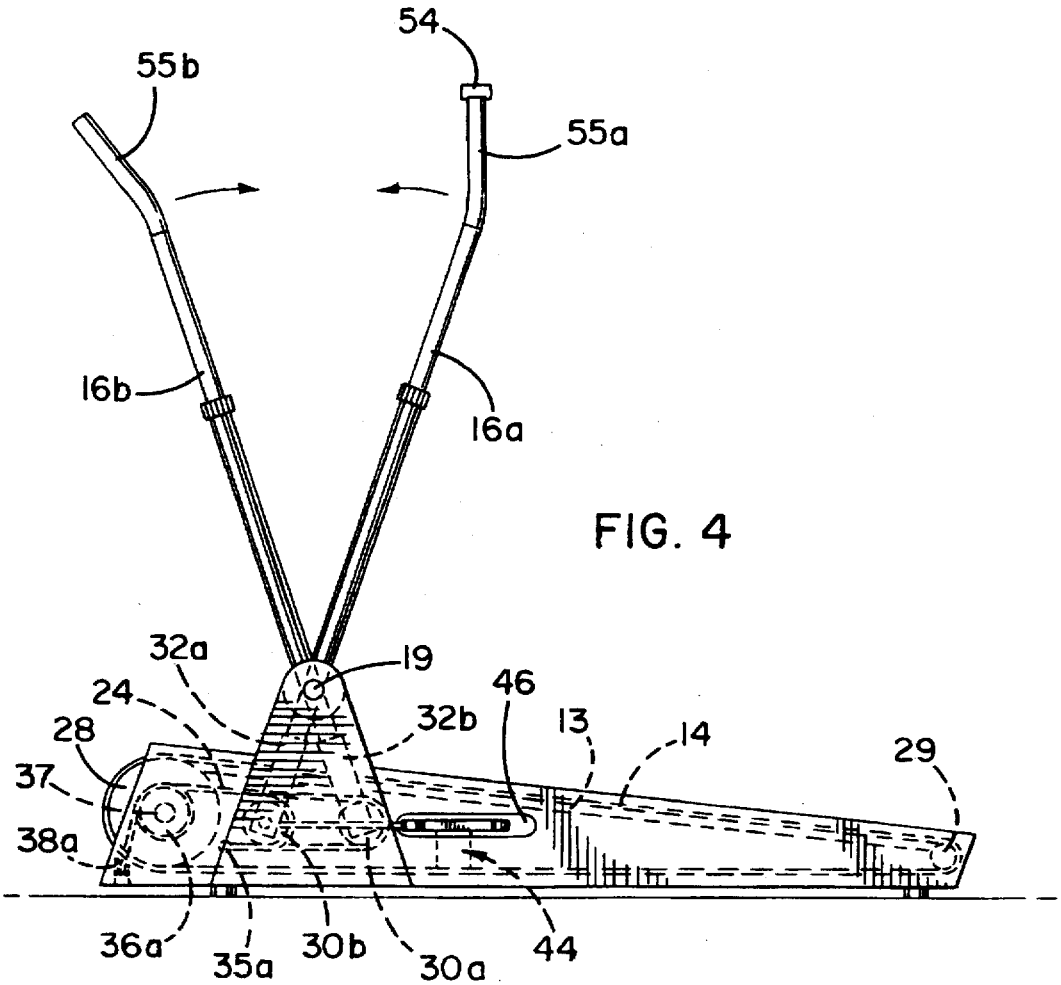
FIG. 4 is a side view of the treadmill illustrating the reciprocating arms of a preferred treadmill embodiment.
Figure 8:
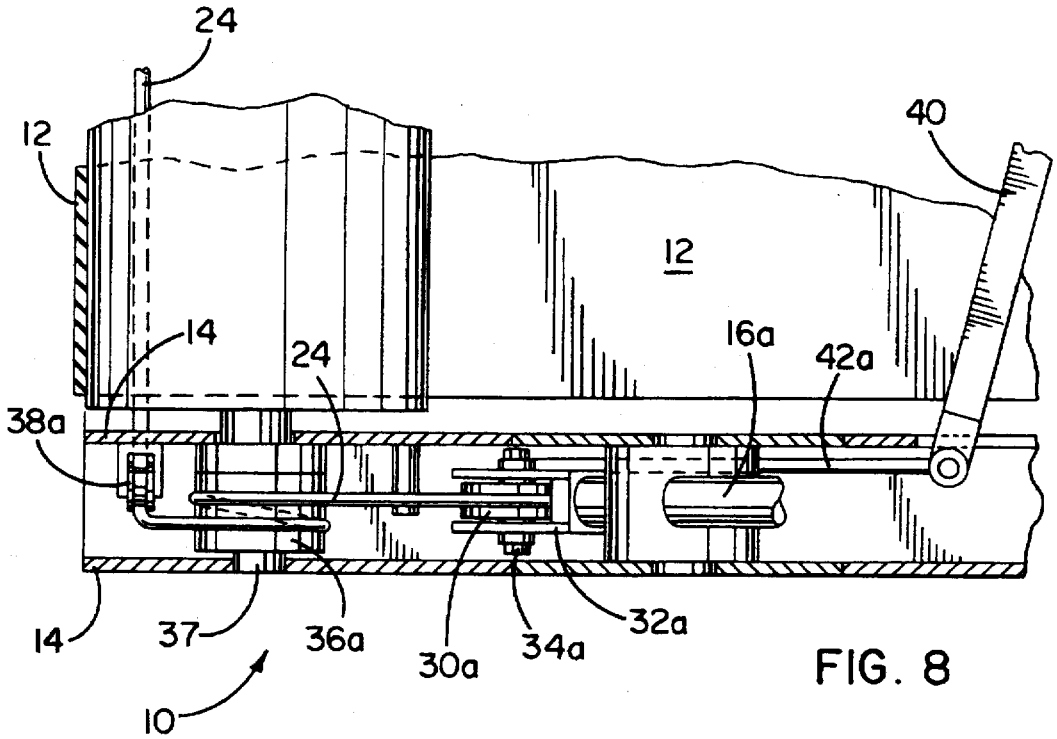
FIG. 8 is a top plan view of the treadmill illustrating the left side of the transmission components.

Turning now to the drawings and referring first to FIGS. 1 and 2, there is shown a treadmill generally designated 10 including an endless belt 12 riding upon a low-friction support surface 13 supported by a base 14. As shown in the drawings, the base 14 is slightly elevated at its forward end with respect to its rearward end such that it is inclined at an angle of six degrees relative to a level surface. Of course, if desired the treadmill may be arranged such that the incline may be varied by any suitable means, such as by providing manually or automatically adjustable feet or framing members, including pneumatic or hydraulic actuators, or motor-driven elevation means. For example, one suitable motor driven elevation means that operates by raising the base with respect to an underlying frame member is described in U.S. Pat. No. 5,462,504, incorporated herein by reference in its entirety.

The treadmill 10 includes generally upright left and right arm members **16*a* and 16*b*, respectively, from the perspective of the user, (i.e. walking up the inclined belt). For ease of understanding herein, components which have a symmetrical counterpart on an opposite side are numbered such that those on the left are denoted by the lower case letter "a" and those on the right by the lower case "b." The arm members 16a and 16b** are preferably of a length wherein a user can grasp them in a reasonably comfortable position when striding, and such that the user's arms and upper body are exercised by movement thereof without overburdening any particular muscle group. As such, the arm members may be adjustable in length, as described in more detail below.

As shown in FIGS. 1 and 2, the base 14 supports the belt 12 and support surface 13, and further serves as a protective housing to prevent users from contacting the moving parts. As such, the base 14 also includes triangular shaped coverings 18a and 18b which protect the user from the movement of the arms below pivot points 19a and 19b where the arms 16a, 16b are pivotally coupled to the base 14.

According to one aspect of the invention, and as shown in more detail in FIGS. 2–8, the movement of the arm members 16a and 16b power a transmission system generally designated 20 that rotates the belt 12 rearwardly. To this end, the reciprocating lower ends of the arm members 16a and 16b wind and unwind a cable 24 on a pulley system 26 that rotates a forward drive roller 28 e.g., in a clockwise direction from the perspective of FIG. 6. As the drive roller 28 rotates, the belt 12, which is coupled thereto so as to not slip under ordinary loads, rotates rearwardly. The belt 12 may be arranged so as to not slip on the drive roller 28 by providing proper tensioning, coefficients of friction and/or having treads in the underside of the belt 12 engage with counterpart treads (not shown) on the drive roller 28. A rear roller 29 is provided at the rear of the treadmill to redirect the belt 12 forwardly. As can be appreciated, the actual functions of the rollers can be reversed, e.g., if desired, the rear roller 29 can be mechanically arranged to function as the driving roller.

To appropriately wind and unwind the cable 24, the pulley system 22 includes left and right reciprocating pulley wheels 30a and 30b coupled to lower ends of the arm members 16a and 16b, respectively. To this end, each arm member 16a, 16b includes a fork-shaped mounting 32a, 32b for supporting the reciprocating pulley wheels 30a, 30b between the forks thereof on axles 34a, 34b. As shown in FIG. 2, the cable 24 is fixed at each end thereof by a bolt or the like 35a, 35b to each side of the base 14. As further shown, beginning at the end of the cable where it is fixed to the left side of the base, the cable is redirected around free-wheeling pulley wheel 30a and in turn around a pulley wheel 36a which is coupled to a drive roller axle 37 to rotate the drive roller 28. From the pulley wheel 36a, the cable 24 is redirected across the front of the treadmill 10 by rollers 38a and 38b. As shown, the rollers 38a and 38b are disposed so that the cable traverses the front of treadmill 10 slightly in front of the axis of the drive roller 28, and are thus preferably oriented at an angle to correspond with the angle of the cable at that point.

From roller 38b, the right side of the cable is wound around a pulley wheel 36b similarly coupled to the opposite side of the axle 37 to rotate the drive roller 28. As can be appreciated, the right side of the belt is arranged to be symmetrical to the left side, and is thus similarly engaged with right pulley wheel 30b before being fixed by bolt 35b to the right side of the base 14.

So that the drive roller 28 only rotates in one direction, the pulley wheels 36a and 36b connected thereto include one-way bearings, as described in more detail below. Such bearings are commercially available from Torrington Corporation, Torrington, Conn., Part No. RCB162117. In addition, to ensure that the arms reciprocate, thus preventing the cable from having any excess slack, the arms are joined at their lower ends through a linkage 40. To this end, the linkage 40 is pivotally connected to rearwardly extending rods 42a, 42b which in turn are coupled to their respective arm portions 16a, 16b at the axles 34a, 34b thereof. The linkage 40 is pivoted at its center to by a pin or the like in a support block 44 fixed with respect to the base 14. For example, the support block 44 may be coupled to the underside of the support surface 13, or may be supported by a similar lower surface or by a transverse support bar (not shown). If the linkage 40 is longer than the width of the inner walls of the base 14, slots 46 or the like may be provided to facilitate movement of the linkage ends.

In operation, as the user pulls a first arm member while pushing the other, the cable 24 rotates the pulley wheels 30a, 30b and 36a, 36b as it moves with the changing distances between those wheels. As shown from FIGS. 5 to 6, the rearward movement of the lower end of arm member 16a rotates wheel 36a in the desired clockwise direction, and thus the one-way bearings are arranged to impart this motion to the drive roller 28. Conversely, the forward movement of the arm (i.e., from FIG. 6 to FIG. 5) rotates wheel 36a counterclockwise, and thus the one-way bearings allow wheel 36a to free-wheel at this time. As can be appreciated, the right side of the pulley system 26 works in the same manner as the left side, i.e., increasing the distance between the right side pulleys 30b and 36b powers the drive roller 28, while the reverse movement has no effect. Even though one-way bearings are employed, at any time the amount of force required to move the arm members 16a, 16b is substantially the same at both members because the arm members 16a and 16b are coupled together by the cable 28. However, it is feasible to have the arm members independently power the drive roller 28, such as by having two non-connected gearing systems independently transfer the movement energy to the drive roller 28.

The ratio of the diameter of the drive roller 28 to the diameters of the various pulleys 30a, 30b and 36a, 36b and the mechanical advantage obtained by the pulley winding ratio has been selected such that a normal length stride corresponds to a normal amount of arm movement for an average user. More particularly, a 23.8 inch maximum arm stroke produces 25.4 inches of belt travel (1.07 to 1.00 belt-to-arm travel) as a result of a 2.33 to 1.00 roller to pulley diameter ratio, and a 2.00 to 1.00 pulley winding ratio. Of course, benefits would be obtained with other ratios of arm movement to belt travel, e.g., from five to thirty inches of arm movement producing anywhere from three to sixty inches of belt travel.

In addition, the treadmill is preferably inclined at six degrees to horizontal, thereby utilizing the weight of the user to assist the force that is supplied by the user's arm movements. Of course, as previously described the incline may be varied. In either situation, however, the speed of the arm movement, which corresponds to the speed of the stride, helps determine the belt speed absent belt slippage. It should be understood, however, that the ratio of arm movement to belt travel is not solely a function of the gear ratio, but is also determined by the weight of the user in conjunction with the incline. For example, with sufficient incline the belt will move freely without any arm movement as a result of the weight of the user. With arm assistance, the belt typically moves further than the gearing alone would dictate because of the weight in conjunction with the incline and because one-way bearings are employed.

Moreover, the conservation of angular momentum, due to the mass and other dimensions of the roller, acts as an energy storage means to make the belt rotation smooth during the transitions from forward to rearward arm movements. If desired, however, an additional energy storage means such as a separate flywheel or the like may be added to further smooth the belt rotation. Thus, as shown in FIG. 11, a flywheel 60 may be provided to augment the initial mass of the drive roller 28 and store rotational energy, thereby further smoothing belt rotation.

To this end, the flywheel 60 comprises a metallic disc or the like rotating on the same axle 37 as the drive roller 28. As shown in FIG. 11, the flywheel 60 returns stored energy to the drive roller 28 via a drive belt system 62. Instead of directly driving the drive roller 28, the transmission system 20 is arranged to rotate the flywheel 60 in one direction using one way bearings as previously described. As the flywheel 60 is rotated, a belt system 62 comprising a first drive belt 64 coupled to an axle 65 of the flywheel 60 rotates a transmission pulley wheel 66. In turn, the transmission pulley wheel 66 rotates a second drive belt 68 couple to rotate the drive roller 28. Because of the one way bearings, when the arm movement is halted and/or reversed, the flywheel 60 continues to rotate, continually releasing rotational energy to the drive roller 28.

Figure 9:
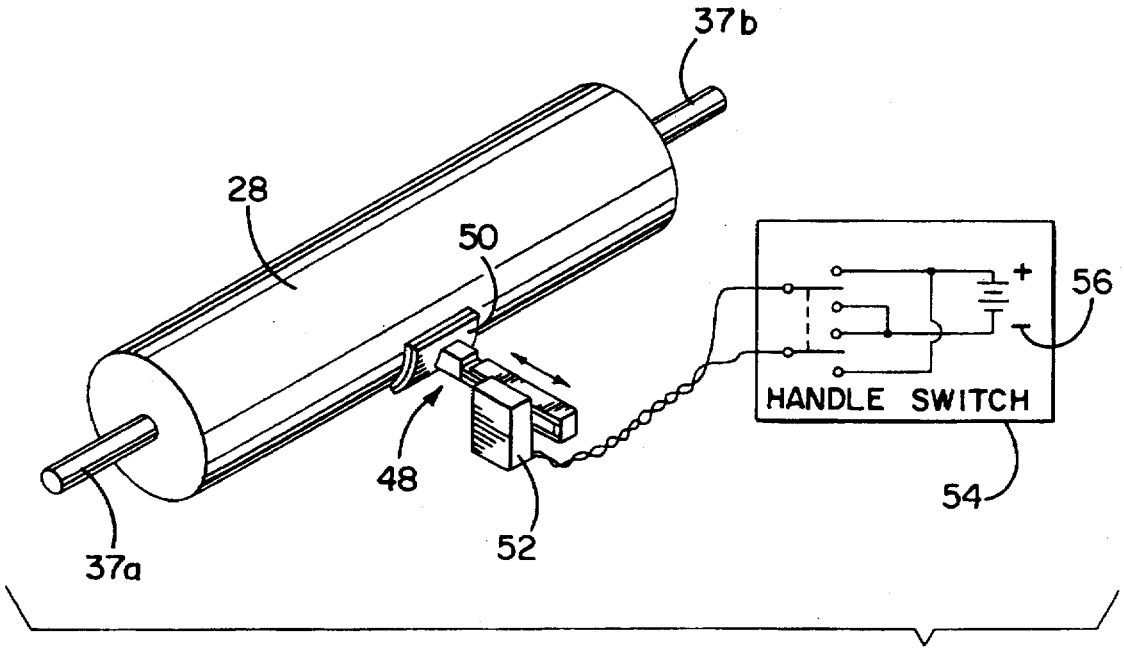
FIG. 9 is a perspective view of the belt roller portion of the treadmill in combination with a braking device.
Figure 11:
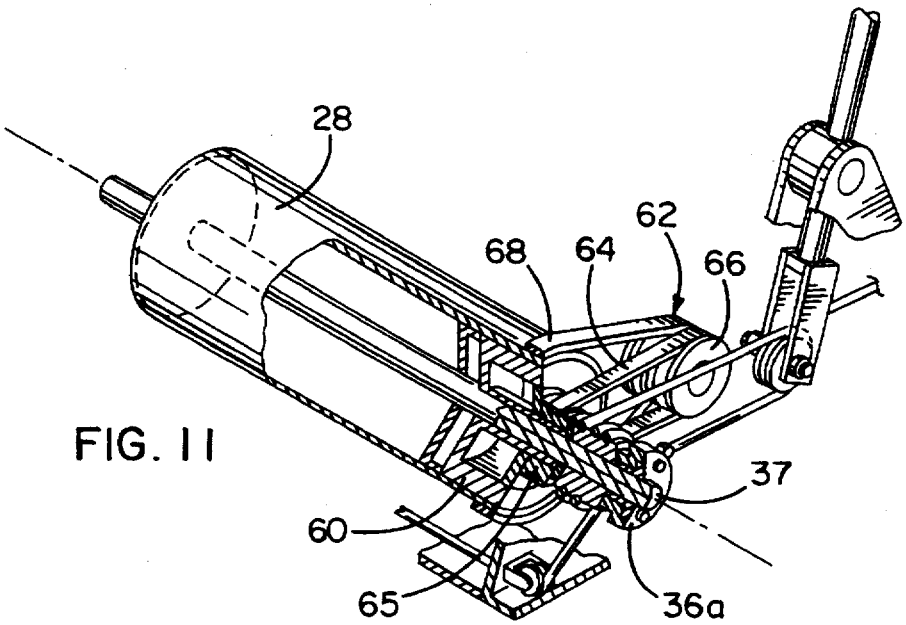
FIG. 11 is a partial perspective view of an alternate embodiment of the invention incorporating a flywheel as an energy storage means.

As can be seen in FIG. 11, due to the various pulley 66, roller 28 and flywheel axle 65 dimensions, the flywheel 60 rotates at three times the rotational speed of the drive roller 28. As can be appreciated, other flywheel locations, spinning ratios and flywheel shapes may be alternatively provided. Moreover, the flywheel may be connected to the rear roller, or can be independent of either roller such as by separately coupling to the belt. A braking system to selectively and/or gradually stop the flywheel upon user demand may also be provided. Although not necessary to the invention, as best shown in FIG. 9, a braking device 48 may be added to regulate the amount of arm force needed to drive the belt, by providing an adjustable frictional force against the drive roller 28. The braking device 48 may be mounted to the base 14 in a manner similar to the support block 44, or may be disposed near one side of the base 14 and mounted directly to the base 14 at that side.

To adjust the force applied by the braking device 48, a brake pad 50 is moved forwardly or rearwardly with respect to the drive roller 28. Preferably, this is accomplished by operating a small motor 52 from a switch 54 disposed on one of the handles **55*a*, 55*b* of the arms 16*a* or 16*b*. For example, a DC motor, manufactured by Dayton Corporation, Chicago, Ill., Model No. 2L003, has been connected to a twelve-volt battery 56 for this purpose. Alternatively, any suitable motor 52 with appropriate power supply 56**, or any manual braking system, will suffice. It should be noted that if a braking motor is used, the treadmill of the present invention may still be considered a substantially motorless device, because the weight, reliability and/or cordless operation of such a small, battery-powered motor is significantly different with respect to drive motors in conventional treadmills.

The braking device 48 ensures that some force must be applied by the user's arms to power the belt 12 regardless of the incline of the treadmill 10 or the weight of the user. As can be appreciated, the braking device 48 is particularly beneficial when attempting to regulate the speed via arm motion with treadmills capable of variable inclines. Moreover, the braking device 48 provides a user with the ability to exercise the upper body a certain amount with respect to the lower body, as the brake setting influences whether a small or large amount of arm force is necessary to move the belt 12. Indeed, it is feasible to regulate the brake setting and/or the incline to control the heart rate of the user.

Figure 10:
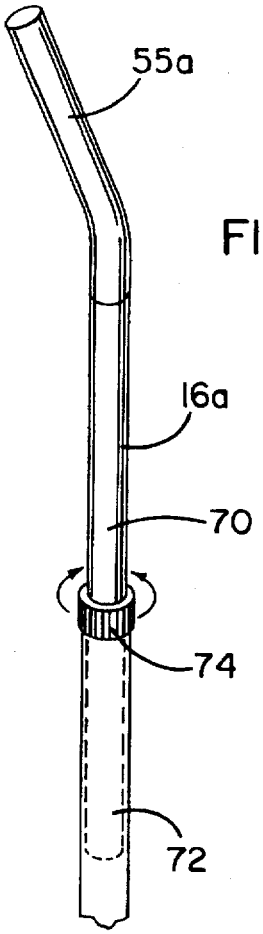
FIG. 10 is a partial perspective view of one of the arm members.

As best shown in FIG. 10, to enhance gripping each handle **55*a* or 55*b* may be angled with respect to its corresponding arm member 16*a* or 16*b*, respectively. Moreover, as previously described, the arm members 16*a*, 16*b* may be variable in length. To this end, as shown in FIG. 10 each arm member such as 16*a* may comprise telescoping sub-members 70 and 72, wherein the outer diameter of one of the sub-members slidably fits within the inner diameter of the other. As is well known in the mechanical arts, (e.g., with microphone stands), a tightening collar 74** or the like may be provided to lock the sub-members together at the desired relative lengths. Other ways of providing variable length arm members, such as by having sub-members with complimentary screw threads, may be alternatively provided.

Finally, although as shown the preferred transmission mechanism 20, which has been successfully operated in a prototype apparatus, employs a pulley-based, mechanical transmission mechanism 20, other non-motorized transmission mechanisms are contemplated by the present invention. For example, other suitable transmission mechanisms for converting arm movement to belt rotation may include a meshed gear arrangement, planetary gearing systems, and hydraulic, pneumatic or electromagnetic based systems.

As can be seen from the foregoing detailed description, there has been provided a motorless treadmill that exercises the upper and lower body of a user. The treadmill belt moves such that the stride of a user feels relatively natural even as the user varies the speed. The amount of upper body exercise can be varied with respect to the amount of lower body exercise. The treadmill is lightweight in design and relatively uncomplicated.

What is claimed is:

1. A treadmill for exercising the upper body and lower body of a user, comprising, a substantially stationary support frame, an endless belt longitudinally supported on the support frame, a pair of displaceable arm members disposed astride the endless belt, each of the arm members being displaceable forwardly and rearwardly relative to the frame by a reciprocating arm movement of the user, a drive roller coupled to the belt, and a transmission system linking the drive roller to the displaceable arm members such that displacement of the arm members drives the belt to rotate in one direction with respect to the support frame wherein the ratio of arm movement distance to belt movement distance is between 0.6 and 2.0.

2. The treadmill of claim 1 wherein the transmission system includes a pulley system.

3. The treadmill of claim 2 wherein the pulley system includes at least one drive pulley coupled to the drive roller for rotation thereof and at least one displaceable pulley coupled to the upper body exercise device for displacement thereby, and further comprising a cable connected between said pulleys such that displacement of the displaceable pulley is translated by the cable into rotation of the drive roller pulley.

4. The treadmill of claim 1 wherein the displaceable arm members are substantially upright and extend upwardly to a corresponding pair of handles.

5. The treadmill of claim 4 further comprising a braking device for opposing rotation of the belt, wherein the braking device is motorized and controlled by a switch proximate one of the handles.

6. The treadmill of claim 4 further comprising a linkage connecting the arm members.

7. The treadmill of claim 6 wherein the linkage couples the arm members for alternating, reciprocating movement.

8. The treadmill of claim 4 further comprising means for adjusting the length of at least one of the upright members.

9. The treadmill of claim 8 wherein the means for adjusting the length of at least one of the upright members comprises telescoping sub-members.

10. The treadmill of claim 4 wherein the transmission system includes a flywheel for storing the kinetic energy of the reciprocating motion of the upright members and for steadily releasing the stored energy to smooth the rotational movement of the belt.

11. The treadmill of claim 10 including means for rotating the flywheel at three times the speed of the drive roller.

12. The treadmill of claim 4 wherein the upper ends of the upright members are angled relative to the lower ends.

13. The treadmill of claim 1 further comprising means for controllably adjusting the angle of inclination of the treadmill.

14. The treadmill of claim 1 further comprising a braking device for opposing rotation of the belt.

15. A method of assisting the rotation of a treadmill belt, comprising the steps of:

inclining the front end of the belt such that gravitational force on a user frictionally coupled to the belt urges the belt rearwardly; and transferring kinetic energy generated by arm movements of a user to rearward movement of the belt to assist the gravitationally induced rearward movement of the belt such that the rearward movement of the belt generated by the arm movements is substantially equivalent to the stride of the user.

16. The method of claim 15 further comprising the step of providing a belt roller connected to the belt for rearward rotation thereof, and wherein the step of transferring the kinetic energy of arm movements comprises the step of rotating a pulley coupled to rotate the drive roller rearwardly.

17. The method of claim 15 further comprising the steps of storing the energy of arm movement, and releasing the stored energy at a more constant rate than stored to smooth the rearward movement of the belt.

18. The method of claim 15 further comprising the step of applying a braking force to impede movement of the belt.

* * * * *

UNITED STATES PATENT AND TRADEMARK OFFICE

CERTIFICATE OF CORRECTION

PATENT NO. : 5,688,209

DATED : November 18, 1997

INVENTOR(S) : Frank R. Trulaske and Daniel R. Moon

It is certified that error appears in the above-identified patent and that said Letters Patent is hereby corrected as shown below:

On the title page, [56] References Cited, under the heading U.S. Patent Documents, please include the following references:

| | | |
|---|---|---|
| 4,313,603 | 02/02/82 | Simjian |
| 4,632,385 | 12/30/86 | Geraci |
| 5,110,117 | 05/05/92 | Fisher et al. |
| 5,226,866 | 07/13/93 | Engel et al. |
| 5,318,491 | 07/07/94 | Houston |
| 5,403,255 | 04/04/95 | Johnston |
| 5,447,479 | 09/04/95 | Gvoich |

Signed and Sealed this

Thirteenth Day of October 1998

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,688,209

DATED : November 18, 1997

INVENTOR(S) : Frank R. Trulaske and Daniel R. Moon

It is certified that error appears in the above-identified patent and that said Letters Patent is hereby corrected as shown below:

On the title page, [56] References Cited, please include the following references:

under the heading U.S. Patent Documents

| | | |
|---|---|---|
| 5,411,455 | 05-1995 | Haber et al. |

Under the heading Foreign Patent Documents

| | | |
|---|---|---|
| 395334 | 10/1908 | Great Britain |

Signed and Sealed this

Twelfth Day of January, 1999

*Attest:*

*Attesting Officer*

*Acting Commissioner of Patents and Trademarks*